United States Patent [19]

Forman

[11] Patent Number: 4,843,656

[45] Date of Patent: Jul. 4, 1989

[54] ONE PIECE TOILET SEAT WITH LIFTING FEATURE

[76] Inventor: Brian Forman, 4429 Main St., Philadelphia, Pa. 19127

[21] Appl. No.: 178,159

[22] Filed: Apr. 6, 1988

[51] Int. Cl.[4] ..... A47K 13/10

[52] U.S. Cl. ..... 4/251; 4/661; 4/237; 4/DIG. 5

[58] Field of Search ..... 4/DIG. 5, 251, 237, 4/234, 661, 248

[56] References Cited

U.S. PATENT DOCUMENTS

| | | | |
|---|---|---|---|
| D. 125,770 | 3/1941 | Jockwig et al. | 4/DIG. 5 |
| D. 161,108 | 12/1950 | Kandarian | 4/237 |
| 936,714 | 10/1909 | Gunton | 4/DIG. 5 |
| 1,999,555 | 4/1935 | Adams | 4/251 |
| 3,717,884 | 2/1973 | Mantooth | 4/237 |
| 3,783,455 | 1/1974 | Vanderbrook | 4/237 |
| 3,935,601 | 2/1976 | Hermann | 4/237 X |
| 4,574,401 | 3/1986 | Nakajima | 4/237 |

FOREIGN PATENT DOCUMENTS

| | | | |
|---|---|---|---|
| 176266 | 2/1906 | Fed. Rep. of Germany | 4/251 |

*Primary Examiner*—Henry J. Recla

*Attorney, Agent, or Firm*—Caesar, Rivise, Bernstein, Cohen & Pokotilow, Ltd.

[57] ABSTRACT

A one piece toilet seat comprising a rim having a central opening. The toilet seat rim has a front and back section. There is an imaginary axis passing through the front and back sections of the toilet seat rim. This axis lies generally perpendicular to the plane of the person using the toilet seat. The toilet seat rim possess a lifting tab means which extends from the rim outwardly of the rim, preferably at an acute angle to the axis. In this way, the toilet seat rim may be raised and lowered by grasping the tab means.

3 Claims, 2 Drawing Sheets

ONE PIECE TOILET SEAT WITH LIFTING FEATURE

FIELD OF THE INVENTION

This invention relates generally to toilet seats, and particularly, a one piece toilet seat with a lifting feature.

From time to time in normal use, it is necessary to raise or lower a toilet seat. With the increasing emphasis on or recognition of various types of communicatability of various social or other diseases, there is a perceived or real danger of infection arising from organisms that may exist on the under side of a toilet seat. Thus, when one has to grasp a conventional toilet seat to raise or lower the same, it is very difficult to avoid contact with either the upper side or under side side or both of a conventional toilet seat.

BACKGROUND ART

The use of a separately attached lifting member in conjunction with a toilet seat has been suggested in U.S. Pat. Nos. 275,838, 723,973 and 985,535. However, it has been recognized now that the use of separately attached lifting devices does not meet the needs of modern society.

First, the separately attached lifting devices inherently create a nesting place for unwanted organisms to form between the lifting device and the toilet seat. Such nesting place will exist in the interface between the lifting device and the toilet seat, or in any depression that may be made in the toilet seat to accommodate the lifting device.

Yet another consideration is the possibility that the separately attached lifting devices can be removed by vandals. This can provide a particular monitoring problem to hotels, restaurants and other public places once it is known that the separable lifting devices can be readily separated from the toilet seat.

OBJECTS AND BRIEF DESCRIPTION OF THE INVENTION

It is therefore an object of the present invention to provide a one piece toilet seat with lifting feature which can be readily used in place of existing toilet seats.

Yet another object of the present invention is to provide a one piece toilet seat with lifting feature which is capable of simple attachment upon the base of a conventional toilet base structure or association with a toilet seat lid.

Still another object of the present invention is to provide a one piece toilet seat with lifting feature which can be manufactured economically.

Still another object of the present invention is to provide a one piece toilet seat with lifting device which is sanitary in use and precludes any bacteria breeding interface and wherein the lifting feature cannot be readily separated from the toilet seat.

The foregoing, as well as other objects of the invention are achieved, by providing a one piece toilet seat which comprises a rim having a central opening. The toilet seat rim has a front and back section, usually symmetrical about an axis passing through the front and back section. Such axis lies generally perpendicular to the plane of a person using the toilet seat. The one piece toilet seat also includes a lifting tab means which extends from the rim, outwardly of the rim at an operable angle to the axis. Thus, the toilet seat can be raised and lowered by simple grasping of the lifting tab means.

DETAILED DESCRIPTION OF THE INVENTION

Figure 1:
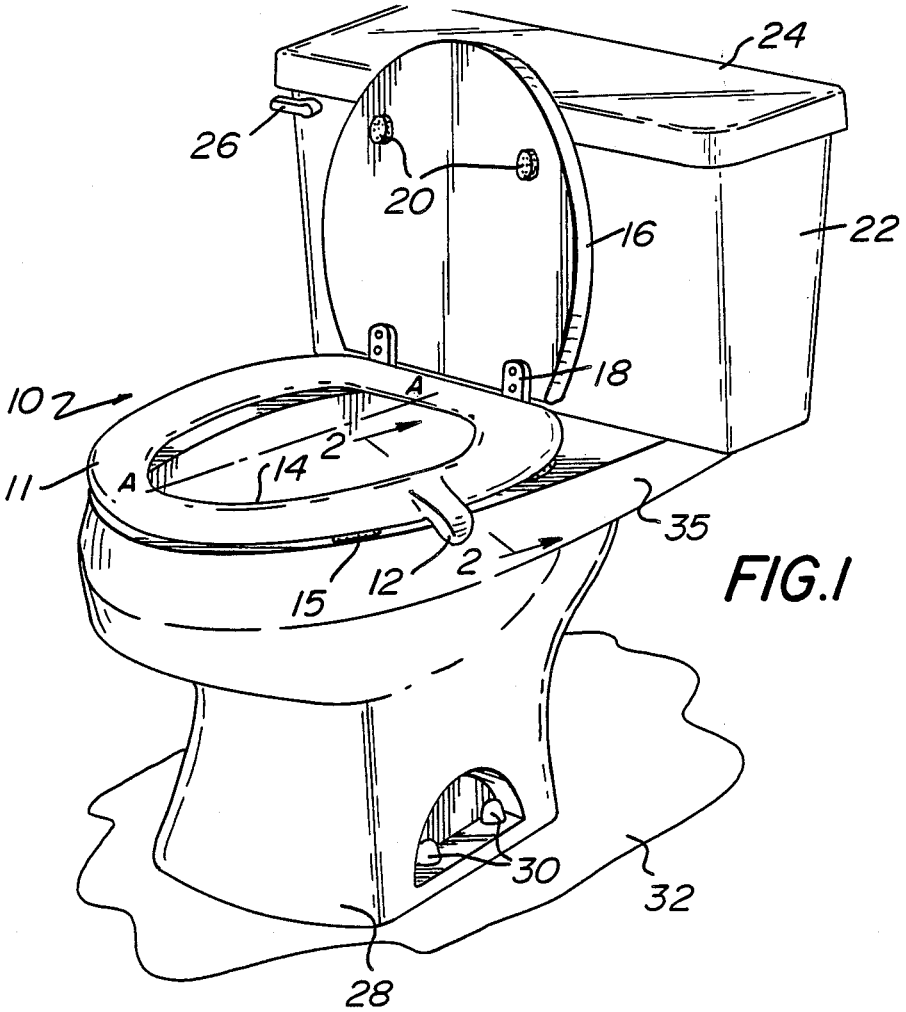
FIG. 1 is a three dimentional view showing the one piece toilet seat with lifting feature of the present invention inserted in place upon the base of a toilet base structure.

Referring now to the various figures of the drawings, wherein like reference characters refer to like parts, there is shown at 10 in FIG. 1, a toilet seat assembly comprising a rim 11 and a lid 16. The rim 11 rests on a pedestal 35 of a conventional toilet base structure 28 (usually ceramic) which is secured to floor 32 by means of fasteners 30.

Also associated with the rim 11 is a lid 16 which is pivotally secured as by hinges 18 to the lid 11 in a conventional manner. Bumpers 20 are provided on the underside of the lid 16 which rest against tank wall 22, with there being a cover 24 and flushing handle 26 in a conventional manner. The underside of rim 11 also has pads 15 (one shown) as can be seen in FIG. 1 and 2.

Attention is now called to FIG. 1 which shows imaginary axis A—A running through the rim 11, including the central opening of the rim. It will be seen that the axis A-A lies generally perpendicular to the plane of a person sitting on the rim 11 when using the toilet seat.

A lifting tab means 12 is provided. The lifting tab means 12 extends outwardly from the rim 11 preferably at an approximately 3 or 4 o'clock position (or about 80° ) with reference to an axis through the lifting tab means 12 when intersecting axis A—A makes an acute angle. However, this angle (operable angle), may vary depending upon various factors, such as the leverage desired and aesthetics.

Figure 2:
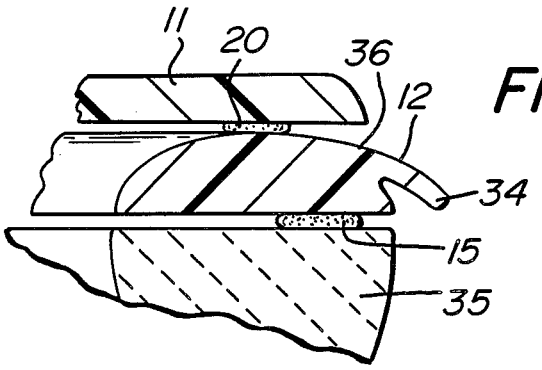
FIG. 2 is an enlarged, fragmentary sectional view taken along the lines 2—2 of FIG. 1.

The details of the lifting tab means 12 can be better seen in FIG. 2 wherein the lifting tab means 12 comprises a finger 36 that terminates in a tip 34.

From the foregoing, it can be seen that it is a very simple matter to lift the rim 11 so that it may be positioned against the lid 20 when lid 16 using tab means 12, is in the upright position of FIG. 1. Alternatively, if the lid 16 is in a generally horizontal position and resting against lid 11, then the grasping of the tab means 12 will result in the simultaneous pivoting of both the rim 11 and the lid 16 to a generally vertical position wherein the lid 16 rests against tank wall 22.

Clearly, the one piece nature of the tab means 12 is such that there is no interface for bacteria to use as a breeding zone. Also, because of the one piece nature of the assembly, it is not possible to remove the tab means 12, except by destruction of the entire assembly.

Figure 3:
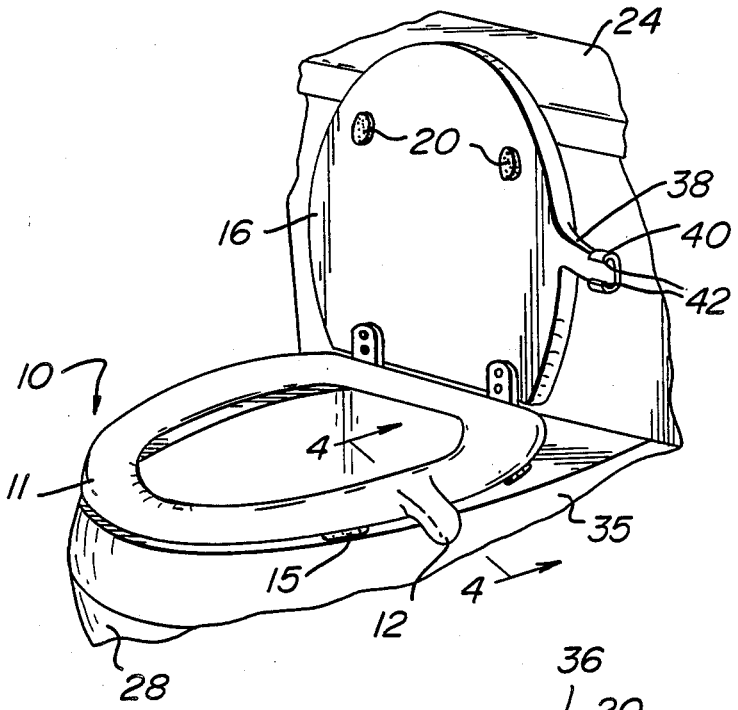
FIG. 3 is a view similar to FIG. 1, but wherein the lid portion has a complimentary extension which extends outwardly to overlie the lifting tab means of the rim portion and wherein there are engaging means associated with the extension to lock the lid extension to the rim lifting tab means, such that the lid and the rim can be raised or lowered together.
Figure 4:
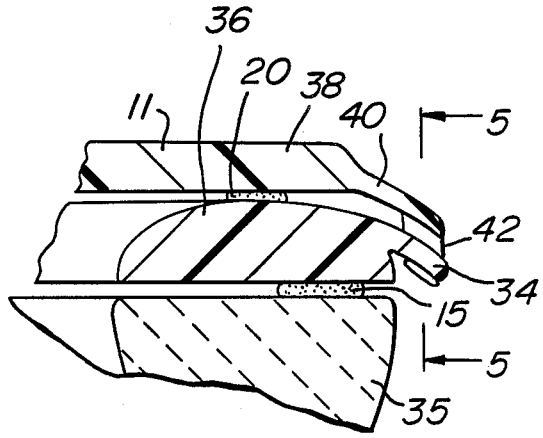
FIG. 4 is an enlarged, fragmentary sectional view taken along the lines 4—4 of FIG. 5.
Figure 5:
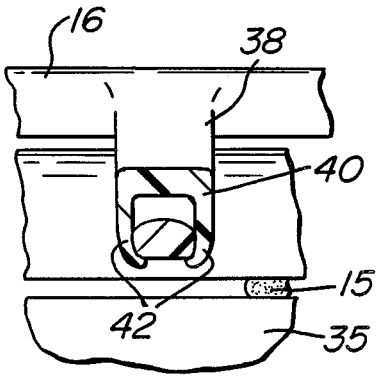
FIG. 5 is a fragmentary, sectional view taken along the lines 5—5 of FIG. 4.

Attention is now called to FIG. 3 to 5 wherein the lid 16 is provided with an extension 38 of one piece, and wherein the extension 38 extends outwardly in grasping resilient fingers 42 (FIG. 5) which extend from outer end of the extension 38. As can be best seen in FIG. 5, the extension 38 of the lid 16 is formed to overlay the lifting tab means 12. With this relationship, the fingers 42 will grasp the tab 12 when the lid 16 is brought into contact with the rim 11 or vice versa. Thus, the rim 11 and lid 16 can move as a single unit when the fingers 42 grasp the lifting tab means 12. Fingers 42 may be one piece with or separately attached to extension 36 and the fingers 42 may be of the same vinyl plastic as the rest of the toilet seat.

When it is desired to pivot the rim 11 away from the lid 16, it is a simple matter to grasp the lifting tab means 12 and disengage it from the fingers 42.

Where desired, deoderant dispensing means or even light means may be associated in a desired manner with either the lid 16 or the rim 11, particularly, where the material from which the lid 16 or rim 11 is a translucent or transparent plastic, such as polyvinyl chloride.

From the foregoing, it can be seen that an attractive and useful assembly is provided wherein the rim 11 of the toilet seat can be raised or lowered at will under sanitary conditions by use of the lifting tab means 12. Also, in some cases, the lid 16 can be raised or lowered, or separated from or moved together with the rim 11 where the lid 16 includes extension 38.

Without further elaboration, the foregoing will so fully illustrate my invention that others may, by applying future knowledge, adopt the same for use under various conditions of service.

What is claimed as the invention is:

1. In a one piece toilet seat and one piece toilet lid comprising a rim having a central opening, said toilet seat rim having a front and back section with an imaginary axis passing through the front and back sections of the rim, said axis lying generally perpendicular to the plane of a person using the toilet seat, and a lifting tab means extending from the rim, outwardly of the rim, at an operable angle to said axis, said rim and tab means being molded as a one piece construction, with said lid, including an extension which is adapted to overlie said lifting tab means when said lid is positioned against said rim and wherein said lid and extension are molded as a one piece construction and said extension includes engaging means adapted to grasp said lifting tab means when in said overlying position whereby said toilet seat may be raised and lowered by manipulating said extension which grasps said tab means.

2. The one piece toilet seat of claim 1, including deoderant dispensing means.

3. The one piece of claim 1, including light means associated with either the toilet seat rim or the toilet seat lid which is made from a translucent or transparent plastic material.

* * * * *